US005351350A

United States Patent [19]

Johnson

[11] Patent Number: 5,351,350

[45] Date of Patent: Oct. 4, 1994

[54] DUSPER

[76] Inventor: Scott C. Johnson, 5920 Muskie Trail, Morris, Ill. 60450

[21] Appl. No.: 75,707

[22] Filed: May 6, 1993

[51] Int. Cl.[5] ..... E04F 21/28

[52] U.S. Cl. ..... 7/105; 15/111

[58] Field of Search ..... 7/105; 15/111

[56] References Cited

U.S. PATENT DOCUMENTS 1,421,478 7/1922 Hope ..... 7/105 X 4,209,865 7/1980 Kozlowski ..... 7/105

4,741,064 5/1988 Riegert et al. ..... 7/105 X

*Primary Examiner*—James G. Smith

[57] ABSTRACT

A tool for scraping paint and dusting the loosened particles away. The tool fits in the pocket of the painter's overalls which is designed for the scraper alone, and it eliminates the need for a separate brush or rag to dust a surface clean for painting. The Dusper has snapping pins on the handle for removing and replacing the brush.

4 Claims, 2 Drawing Sheets

DUSPER

BACKGROUND

1. Field of Invention

This invention relates in general to preparing a surface before painting, and in particular, to smoothing a surface by scraping and then dusting loose particles away using one tool with interchangeable brushes.

2. Description of Prior Art

Every professional painter must carry a paint scraper and a duster or rag. The scraper fits conveniently in a specific pocket in the painter's uniform pants. On the other hand, carrying a duster is inconvenient because it doesn't fit comfortably in any pocket of the painter's uniform.

As an area to be painted is scraped, it must then be dusted to remove the loosened particles. Presently, the painter must have with him a rag or a brush to complete this task. Often this requires a trip down a ladder or a search for a brush or a rag. This results in lost time and is an inefficient manner of preparing a surface for paint.

Likewise, novice painters face the same problem—the need for a scraper and a brush. The novice will often scrape with a paint scraper, but failing to have a duster or brush handy, he or she may paint a surface that is incorrectly prepared. This results in inefficiency as well because the paint will not adhere to a surface which is not properly prepared.

The Dusper eliminates the need for carrying two separate tools for scraping and dusting. In addition, it fits conveniently in the pocket of the painter's pants which is specifically for the scraper alone. It is designed so that the dusting and scraping ends of the tool are a corresponding size.

Since scrapers are made of steel, they last for a long period of time. Brushes, however, quickly wear out even when they are constructed of the most durable materials. Therefore, the Dusper is designed with replaceable brushes. The worn-out brush is easily removed and a new one inserted in its place.

The Dusper can be made for slightly more money than the cost of the scraper alone. By using one sturdy handle it is possible to manufacture and sell the Dusper less expensively than it would be for two separate tools.

In conclusion, the Dusper makes the process of scraping and dusting efficiently accomplished with one tool. This tool is versatile, accessible, and practical to fit the needs of the professional painter and the novice as well.

OBJECTS AND ADVANTAGES

Accordingly, several objects and advantages of my invention are:

(a) to provide one tool which accomplishes the operations of both scraping and dusting a surface to be painted.

(b) to provide a tool which will fit in a specific pocket of the professional painter's uniform.

(c) to provide a tool with a replaceable dusting brush when the existing one is worn out.

(d) to provide a tool which insures that painting preparation is expertly done even by the novice painter.

(e) to provide a tool which is more cost efficient than the purchase of two separate items.

(f) to provide a scraper and duster together in one corresponding size.

Further objects and advantages of my invention, the Dusper, will become apparent from a description of the drawings and the ensuing description of it.

Figure 1:
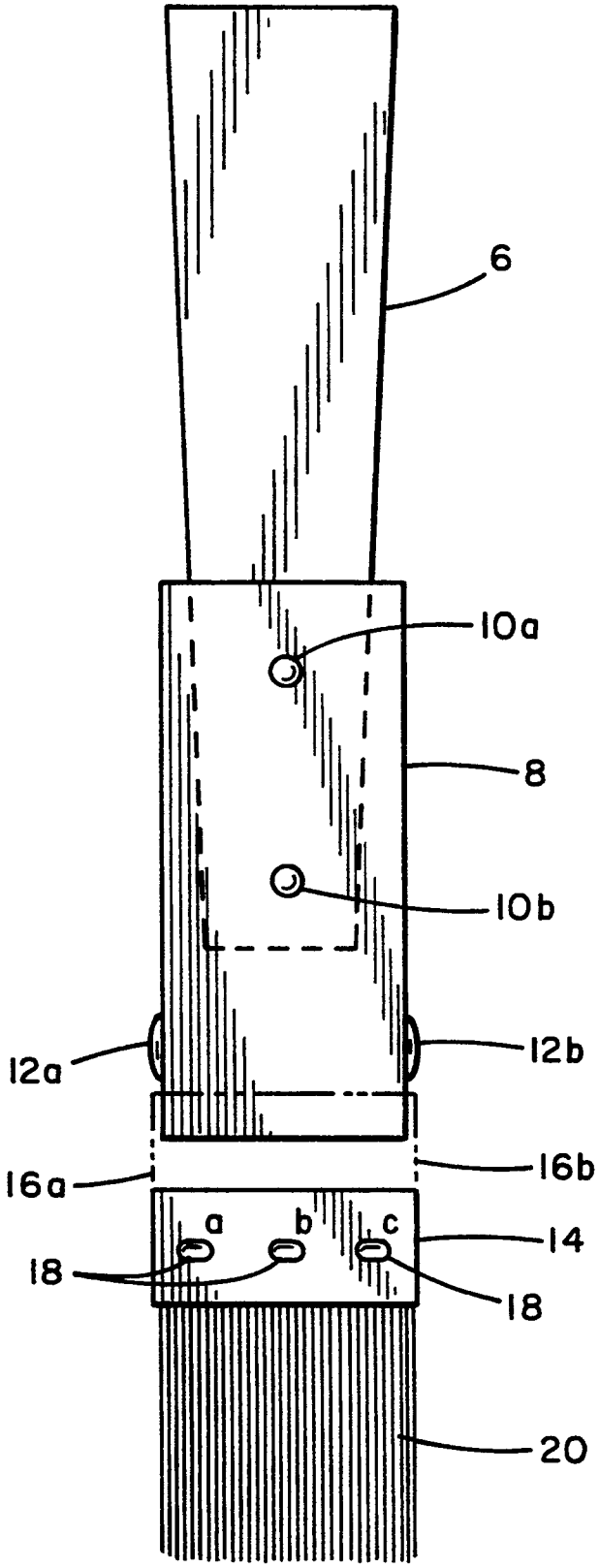
FIG. 1 drawing of the Dusper tool in whole.
Figure 2:
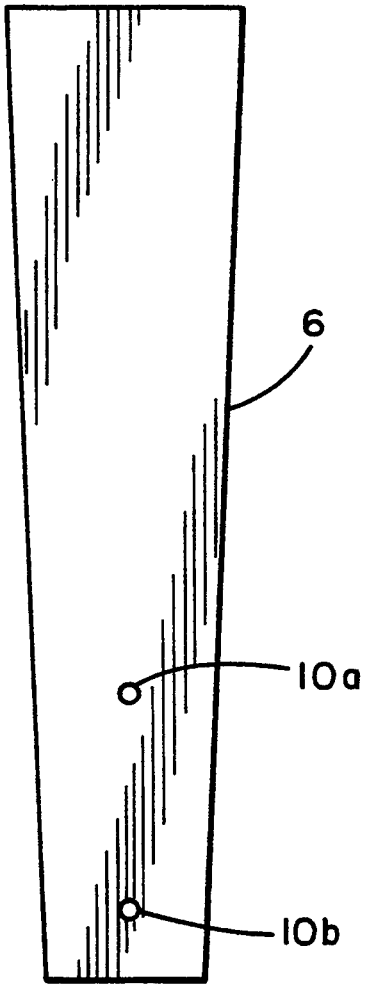
FIG. 2 is the steel scraping part of the tool which will be fastened inside of the handle.
Figure 3:
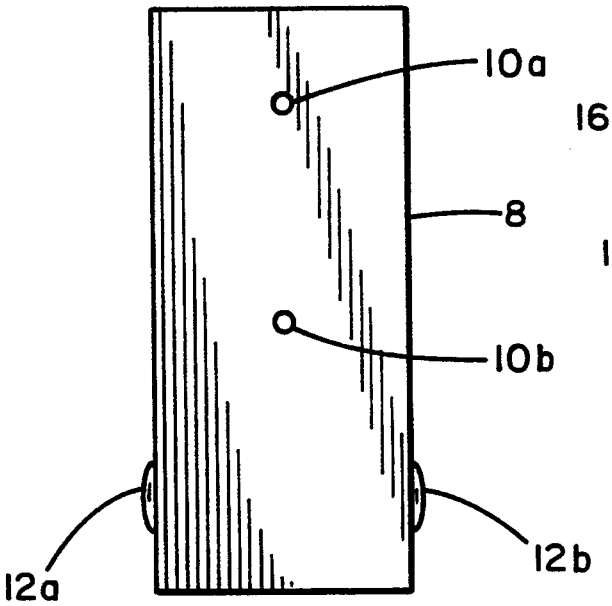
FIG. 3 is the plastic handle of the tool which will allow the dusting piece of the Dusper to be attached to it.
Figure 4:
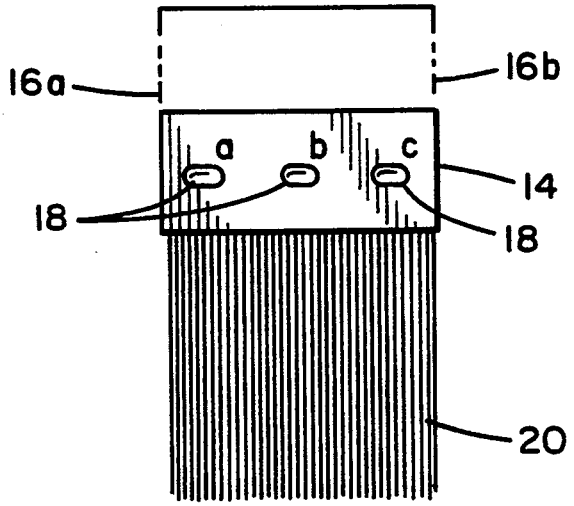
FIG. 4 is the dusting part of the Dusper used for sweeping away unwanted loose particles before painting.

| Reference Numerals in Drawings | |
|---|---|
| 6 paint scraper | 14 brush support form |
| 8 handle | 18a,b,c, metal rivet |
| 10a metal rivet | 20 polyester nylon bristle brush |
| 10b metal rivet | 16a,b holes |
| 12a metal snapping pin | |
| 12b metal snapping pin | |

DETAILED DESCRIPTION

As shown in the drawings, the Dusper consists of a hardened steel blade (6) which is used for scraping flaking paint or rough surfaces. The blade is molded in plastic which in turn makes the handle (8). The handle has two metal rivets (10*a* and *b*) connected to the blade (6) which give added support.

The handle also has two metal snapping pins (12*a* and *b*) molded in the plastic handle which will allow the dusting part of the tool to be snapped into place.

The dusting end of the tool consists of polyester/nylon bristles (20) and a metal support form (14) which is held together by rivets (18*a,b,c*). The support form (14) will also allow the bristles to be fastened to it by glueing them inside the form.

The support form (14) will also have holes in each side of it so that when the snapping pins (12*a* and *b*) are simultaneously depressed the handle (8) can slide into the support form (14).

The dusting part of the tool will be replaceable because the scraping part of the tool will generally outlive the bristles of the Dusper. When a new brush is needed (14, 16, 18, and 20) can be replaced.

OPERATION OF INVENTION

The Dusper is one tool designed to accomplish the tasks of scraping and brushing away loosened particles as the painter prepares a surface for paint.

Reference numeral 6 is a hardened steel blade which is used for the scraping. The blade is molded in a plastic handle (8). Metal rivets (10*a* and 10*b*) give added support to the handle. Metal snapping pins (12*a* and 12*b*) are molded in the plastic handle on each side. The pins allow easy replacement of the dusting brush with its polyester nylon bristles (20) encased in a metal support form (14) and held together by rivets (18*a*, 18*b*, and 18*c*). Holes (16*a* and 16*b*) in either side of the support form (14) will align with the metal snapping pins (12*a* and 12*b*).

The brush is used to dust away particles which the scraper has loosened. With one tool in hand, the painter may efficiently scrape and dust a surface.

SUMMARY, RAMIFICATIONS, AND SCOPE

Thus, the reader will see that the Dusper provides one tool that accomplishes both of the preliminary painting tasks, scraping and dusting. Additional advantages include the fact that it will fit in a specific pocket of the painter's uniform. Also, the dusting brush can be replaced by simply depressing two snapping pins. One tool to do two tasks is more cost-efficient, and finally, with the Dusper painting preparation will be properly completed.

While my description contains many specificities, these should not be construed as limitations on its possibilities. Variations are possible. These include variations in size, type of material used, weight, and shape. It is possible that the Dusper could be made without an interchangeable brush or with an interchangeable scraper. Variations in the length of the brush bristles are also possible. These are but a few of the possibilities of the Dusper.

I claim:

1. A combination tool comprising:

a rigid blade for scraping paint having at one end a molded, plastic handle, said handle secured to said blade by fastening means;

detent means on said handle at an end opposite to said blade;

a brush member having bristles at one end secured to a support frame, said support frame having recess means for receiving the detent means of said handle;

whereby said brush member can be removed from said handle and blade by depressing the detent means to disengage the detent means from said recess means on said brush member.

2. A combination tool according to claim 1 wherein said brush member is a dusting brush and wherein said bristles are made of a polyester nylon material.

3. A combination tool according to claim 1 wherein said support frame is metal.

4. A combination tool according to claim 2 wherein said bristles are secured to said support frame by glue.

* * * * *